United States Patent [19]

Kikuchi et al.

[11] Patent Number: 4,775,306

[45] Date of Patent: Oct. 4, 1988

[54] CONCRETE FLOOR FINISHING MACHINE

[75] Inventors: Kimio Kikuchi; Takayoshi Imai, both of Sakai; Shigeru Yamada, Sakura, all of Japan

[73] Assignees: Kabushiki Kaisha Takenaka Koumuten, Osaka; Sanwa Kizai Kabushiki Kaisha, Tokyo, both of Japan

[21] Appl. No.: 15,086

[22] PCT Filed: May 22, 1986

[86] PCT No.: PCT/JP86/00263

§ 371 Date: Feb. 20, 1987

§ 102(e) Date: Feb. 20, 1987

[87] PCT Pub. No.: WO86/07109

PCT Pub. Date: Dec. 4, 1986

[30] Foreign Application Priority Data

May 24, 1985 [JP] Japan ..... 60-112913

[51] Int. Cl.[4] ..... B28B 11/08

[52] U.S. Cl. ..... 425/62; 51/177; 404/112; 425/456; 425/458

[58] Field of Search ..... 425/59, 60, 62, 63, 425/458, 87, 363, 456; 264/162; 404/112; 51/174, 177; 15/49 R, 50 R, 87, 98

[56] References Cited

U.S. PATENT DOCUMENTS

| | | | |
|---|---|---|---|
| 822,050 | 5/1906 | Jenkins | 51/177 |
| 3,146,559 | 9/1964 | Wilkinson | 51/177 |
| 4,312,603 | 1/1982 | Whiteman | 404/112 |

FOREIGN PATENT DOCUMENTS

| | | | |
|---|---|---|---|
| 635437 | 1/1962 | Canada | 404/112 |
| 47159 | 3/1985 | Japan . | |

*Primary Examiner*—Jay H. Woo
*Assistant Examiner*—C. Scott Bushey
*Attorney, Agent, or Firm*—Edwin E. Greigg

[57] ABSTRACT

This disclosure relates to a concrete floor finishing machine for smoothing a concrete floor surface while the placed concrete is in a semi-hardened state, and enables a floor finishing machine to be laid directly on the smoothed concrete floor. This concrete floor finishing machine includes finishing units which are arranged on the outer sides of a pair of left and right travelling means provided on a wheel unit. These finishing units consist of a plurality of trowels, respectively, which are arranged radially around the travelling means, respectively, these trowels being adapted to be turned around the travelling means.

8 Claims, 3 Drawing Sheets

CONCRETE FLOOR FINISHING MACHINE

DESCRIPTION

1. Technical Field

The present invention relates to a concrete floor finishing machine for finishing concrete floor surfaces after concrete is deposited, and more particularly to a concrete floor finishing machine comprising a vehicle body including a pair of propelling devices, and a finishing device for smoothing out concrete floor surfaces in half-set state.

2. Background Art

A known finishing machine of this type comprises a vehicle body including a pair of propelling devices, and a finishing device rotatable about the vehicle body as disclosed in Japanese patent application laid open under No. 60-47159 for example. This known finishing machine having the finishing device rotatable about the vehicle body has great practical advantages in that it is capable of finishing a large area in one run compared, for example, with a machine having a finishing device drawn by a vehicle body, and that its propelling devices leave no traces on the concrete floor surfaces regardless of the running direction of the propelling devices.

However, since the finishing device rotates about the vehicle body, its radius of rotation tends to be large and the entire finishing device itself must be large. This renders the finishing device heavy and accordingly requires large and heavy bearings and motor. As a result, the entire finishing machine becomes complicated and heavyweight. During a finishing operation, therefore, the propelling devices tend to mar the concrete floor surfaces to excess. Further, since this known finishing machine cannot readily make a small sharp turn and its finishing device has a large radius of rotation, it inevitably leaves large unfinished parts in corners of the concrete floor. This machine is unsuitable for finishing a small area of concrete floor in particular, and leaves room for improvement in this respect.

DISCLOSURE OF INVENTION

The present invention has been made having regard to the above-noted disadvantages of the prior art, and its object is to provide a compact and lightweight concrete floor finishing machine retaining the advantages of the known finishing machine and yet capable of finishing a small area of concrete floor also.

In order to achieve this object a concrete floor finishing machine according to this invention is characterized in that finishing devices are provided one for each of the propelling devices to be driven to revolve around the propelling devices, respectively.

Since the finishing devices are driven to revolve around the propelling devices, respectively, the finishing devices themselves are substantially reduced in size and weight compared with the known finishing device rotatable around the vehicle body although the number of finishing devices is twice. As a result, bearings, motors and other components are also reduced in size and weight, rendering the entire finishing machine itself compact and lightweight. Moreover, these finishing devices have a substantially diminished radius of rotation thereby to greatly reduce unfinished parts left in corners of the concrete floor.

It will be understood from the above description that the concrete floor finishing machine according to the present invention retains the advantages of the known finishing machine noted at the outset of this specification and yet is compact and lightweight to perform a finishing operation leaving only small unfinished parts in corners of the concrete floor. Therefore this finishing machine is capable of finishing a small area of concrete floor by making full use of its ability to make small sharp turns and without marring the floor surfaces to excess.

BRIEF DESCRIPTION OF DRAWINGS

The drawings illustrate concrete floor finishing machines embodying the present invention, in which.

BEST MODE FOR CARRYING OUT THE INVENTION

Figure 1:
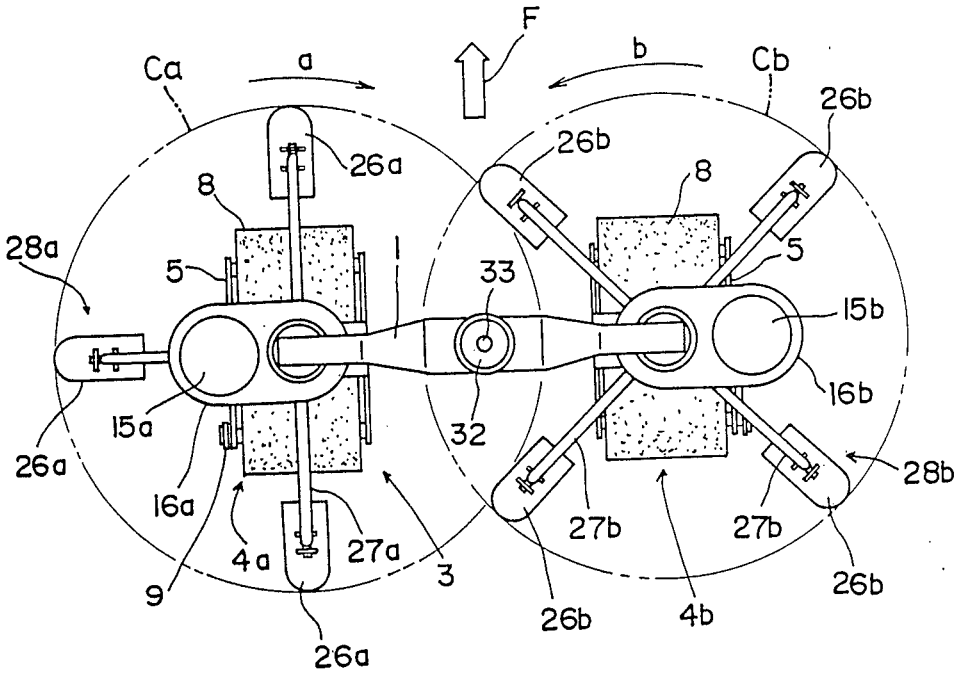
FIG. 1 is a plan view of a concrete floor finishing machine.
Figure 3:
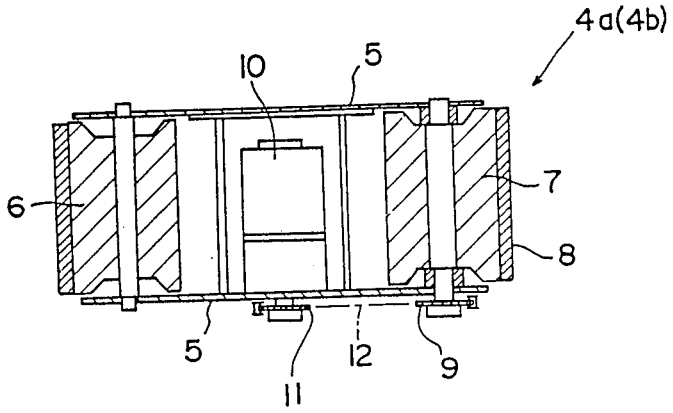
FIG. 3 is a sectional view taken on line III—III of FIG. 2.
Figure 2:
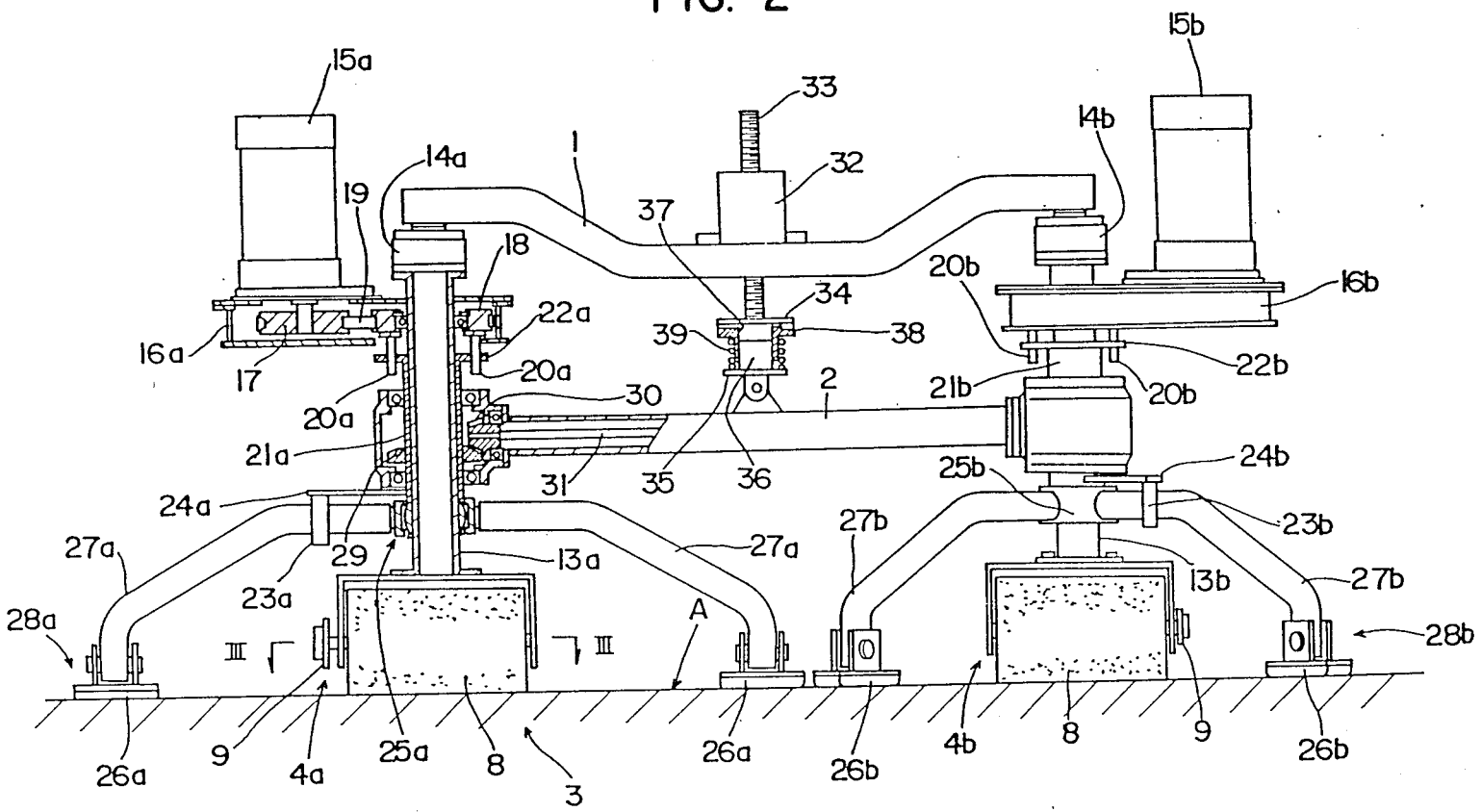
FIG. 2 is a partly broken away front view of the finishing machine.

An embodiment of the invention will now be described referring to FIGS. 1 through 3. A concrete floor finishing machine shown therein comprises a frame member 1 and a tubular member 2 constituting parts of a vehicle body 3. The vehicle body 3 includes a pair of right and left propelling devices 4*a* and 4*b* in a lower portion thereof. As shown in detail in FIG. 3, each of the propelling devices 4*a* and 4*b* includes a pair of fore and aft pulleys 6 and 7 supported by a frame 5 and a crawler 8 formed of rubber extending between the pulleys 6 and 7. The propelling device is driven backward and forward by a motor 10 through a sprocket 9 fixed to the rear pulley 7, a sprocket 11 fixed to the motor 10 and a chain 12 extending between and in mesh with the two sprockets 9 and 11. The frames 5 of the respective propelling devices 4*a* and 4*b* provide support for vertical tubular members 13*a* and 13*b* whose upper ends are operatively connected to the frame member 1 through clutches 14*a* and 14*b*. The tubular members 13*a* and 13*b* carry gear cases 16*a* and 16*b* fixed thereto which support motors 15*a* and 15*b*, respectively.

Each of the gear cases 16*a* and 16*b* houses a pulley 17 fixed to the motor 15*a* or 15*b*, a pulley 18 relatively rotatably mounted on the tubular member 13*a* or 13*b*, and a belt 19 extending between the two pulleys 17 and 18. The pulley 18 mounted on the tubular member 13*a* or 13*b* includes a plurality of pins 20*a* or 20*b* depending therefrom. These pins 20*a* or 20*b* respectively extend into perforations formed in a flange 22*a* or 22*b* of a rotatable tubular member 21*a* or 21*b* relatively rotatably and slidably fitted on the tubular member 13*a* or 13*b*. Each of the rotatable tubular members 21*a* and 21*b* carries a bracket 24*a* or 24*b* fixed to a lower position thereof and including an arm 23*a* or 23*b* projecting downwardly from an extreme end of the bracket 24*a* or 24*b*. Each rotatable tubular member 21*a* or 21*b* carries a self-aligning bearing 25*a* or 25*b* at or adjacent a lower end thereof through which a finishing device 28*a* or 28*b* is attached to the rotatable tubular member 21*a* or 21*b*. The finishing device 28*a* or 28*b* includes a total of four trowel members 26*a* or 26*b* for smoothing out a concrete floor A in half-set state, and support members 27*a* or 27*b* for supporting the trowel members 26*a* or 26*b*, respectively. The finishing device 28*a* or 28*b* is rotatable about the tubular member 13*a* or 13*b*, with the arm 23*a* or 23*b* abutting against one of the support members 27*a* or 27*b*. As seen from FIG. 1, the finishing devices 28*a* and 28*b* have respective extreme ends thereof movable on paths of revolution C*a* and C*b* overlapping each other in plan view.

The rotatable tubular members 21*a* and 21*b* each carry a bevel gear 29 fixed to an intermediate position thereof and meshed with a bevel gear 30 fixed to an end of a rotary shaft 31 mounted in the tubular member 2, whereby the two rotatable tubular members 21*a* and 21*b* are operatively interconnected and, as described later, the two finishing devices 28*a* and 28*b* are driven in synchronism. A linear motor 32 is fixedly mounted on the frame member 1 for rotating a screw shaft 33 in mesh with a threaded bore, not shown, defined in the frame member 1, the screw shaft 33 carrying a plate 34 at a lower end thereof. The tubular member 2 carries a shaft 36 pivoted thereto and including a plate 35. A load sensor 38 is attached to a tubular member 37 relatively slidably fitted on the shaft 36. The load sensor 38 is elastically pressed against the plate 34 on the screw shaft 33 by a compression spring 39 mounted between the plate 35 and the tubular member 37.

The foregoing concrete floor finishing machine operates as follows. For carrying out a finishing operation, the clutches 14*a* and 14*b* are locked to rigidly connect the two tubular members 13*a* and 13*b* to the frame member 1, and the motors 10 rotate the right and left crawlers 8 to propel the vehicle body 3 backward or forward. At the same time, the other motors 15*a* and 15*b* rotate in opposite directions, causing rotation of the pulleys 17, belts 19, and pulleys 18. This causes the right and left pins 20*a* and 20*b* to revolve and the two rotatable tubular members 21*a* and 21*b* to rotate in opposite directions. Then, through the brackets 24*a* and 24*b* the arms 23*a* and 23*b* are caused to revolve into contact with one of the support members 27*a* and one of the support members 27*b*, respectively, thereby rotating the finishing devices 28*a* and 28*b* about the propelling devices 4*a* and 4*b* in opposite directions. The trowel members 26*a* and 26*b* at extreme ends of the revolving support members 27*a* and 27*b* smooth out surfaces of the concrete floor A. In other words, as shown in FIG. 1, the finishing devices 28*a* and 28*b* rotate in opposite directions indicated by arrows a and b while the vehicle body 3 advances in the direction of arrow F.

Since the finishing devices 28*a* and 28*b* are driven to rotate around the propelling devices 4*a* and 4*b*, respectively, each finishing device has a small radius of rotation well suited for finishing corners of the concrete floor A. And since the finishing devices 28*a* and 28*b* are driven to rotate in opposite directions, reactions acting on the finishing devices 28*a* and 28*b* offset each other to prevent a zigzag movement of the vehicle body 3. However, it is not absolutely necessary to rotate the finishing devices 28*a* and 28*b* in opposite directions. The reactions acting on the finishing devices 28*a* and 28*b* may be offset, for example, by differentiating speeds of the right and left propelling devices 4*a* and 4*b*, to permit the finishing devices 28*a* and 28*b* to rotate in the same directions.

During the finishing operation, the load sensor 38 constantly detects the reactions acting on the finishing devices 28*a* and 28*b*, and in response to the detections the linear motor 32 is reversed to control pressing forces of the finishing devices 28*a* and 28*b* with respect to the concrete floor A. This assures uniform finish over an entire area of the concrete floor A. Furthermore, since the two rotatable tubular members 21*a* and 21*b* are operatively connected and synchronized with each other by the bevel gears 29 and 30 and the rotary shaft 31, the extreme ends of the finishing devices 28*a* and 28*b* have the mutually overlapping paths of revolution Ca and Cb and do not leave unfinished floor surfaces. The left trowel members 26*a* and the right trowel members 26*b* are placed out of phase beforehand and are never shifted into collision with each other even if a great load acts on either the left trowel members 26*a* or right trowel members 26*b*.

For changing the traveling direction of the vehicle body 3, the linear motor 32 is rotated to lift the propelling devices 4*a* and 4*b*, the clutches 14*a* and 14*b* are disengaged in this state and the two motors 15*a* and 15*b* are rotated. Then the motors 15*a* and 15*b* revolve with the tubular members 13*a* and 13*b* about axes of the tubular members 13*a* and 13*b*, respectively, thereby turning the propelling devices 4*a* and 4*b*. Since the propelling devices 4*a* and 4*b* are lifted when their traveling direction is changed, the concrete floor surfaces are not marred by the propelling devices 4*a* and 4*b*.

The concrete floor finishing machine operates as described above. This finishing machine may have the drive mechanisms operable by remote control or may be automatically controllable by means of a microcomputer.

Figure 4:
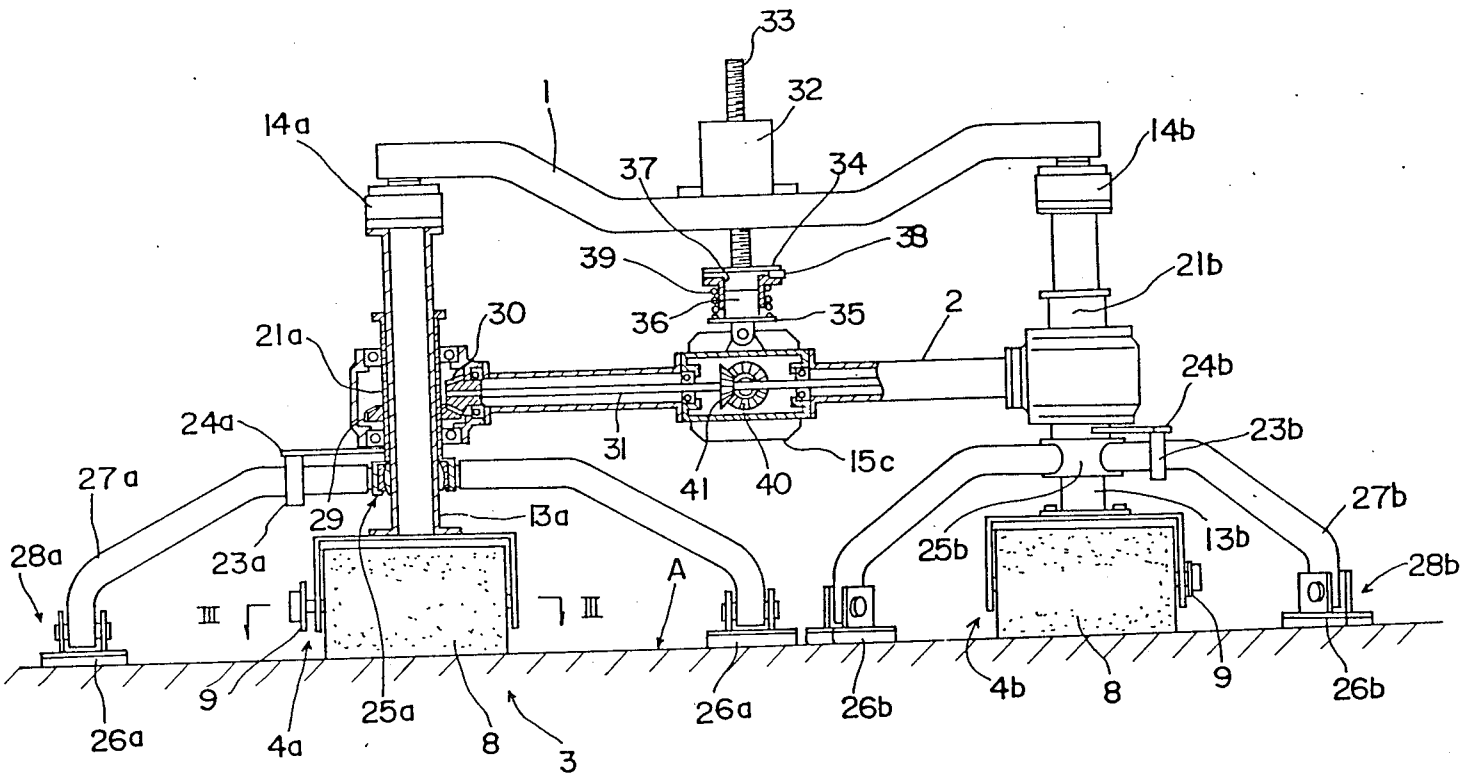
FIG. 4 is a partly broken away front view of a modified finishing machine.

While in the described embodiment the finishing devices 28*a* and 28*b* are driven by the motors 15*a* and 15*b* provided separately, the two finishing devices 28*a* and 28*b* may be driven by a single motor as shown in FIG. 4. This embodiment includes a motor 15*c* fixed to a substantially middle position of the tubular member 2 for driving a bevel gear 40, and a rotary shaft 31 mounted in the tubular member 2 and carrying a bevel gear 41 fixed thereto and meshed with the bevel gear 40.

According to this embodiment, therefore, the motor 15*c* rotates the rotary shaft 31 through the bevel gears 40 and 41, and the rotary shaft 31 in turn rotates the rotatable tubular members 21*a* and 21*b* in opposite directions through the bevel gears 30 fixed to opposite ends of the rotary shaft 31 and the bevel gears 29 fixed to the rotatable tubular members 21*a* and 21*b*. The other power transmitting elements function in the same manner as in the preceding embodiment, and the finishing devices 28*a* and 28*b* rotate in opposite directions about the propelling devices 4*a* and 4*b*, respectively. This feature, as in the preceding embodiment, assures excellent finishing work adjacent corners of the concrete floor A, prevents a zigzag movement of the vehicle body 3, and prevents the finishing devices 28*a* and 28*b* from colliding with each other even though the extreme ends thereof are movable on the mutually overlapping paths of revolution Ca and Cb. In addition, this embodiment requires only one motor 15*c* though the motor 15*c* may somewhat be large, and accordingly dispenses with the gear cases 16*a*, 16*b*, pulleys 17, 18 and belts 19, which has the advantage of rendering the entire machine lightweight. Since the other constructional and functional features of this embodiment are the same as those of the preceding embodiment, like references are affixed to like elements and explanations thereof are not repeated.

INDUSTRIAL APPLICABILITY

As described, the concrete floor finishing machine according to the present invention is suited for efficiently smoothing out concrete floor surfaces in half-set state.

We claim:

1. A concrete floor finishing machine comprising a vehicle body, a pair of rotatable finishing means supported by said vehicle body for smoothing out concrete floor surfaces in a half-set state, a pair of propelling means supported relative to said vehicle body by upright cylindrical elements which upright cylindrical elements are rotatable relative to said vehicle body, one each of said propelling means confined within an area encompassed by each of said rotatable finishing means, means for rotating said finishing means wherein said finishing means are driven to revolve around each said upright cylindrical elements that support said propelling means, said pair of propelling means being driven by a separate drive means.

2. A concrete floor finishing machine as claimed in claim 1 wherein the finishing means are driven to revolve around the propelling means in opposite directions.

3. A concrete floor finishing machine as claimed in claim 2 wherein the finishing means respectively have extreme ends movable on paths of revolution overlapping each other and are driven to revolve in synchronism.

4. A concrete floor finishing machine as claimed in claim 3 wherein the finishing means are driven by separate motors.

5. A concrete floor finishing machine as claimed in claim 3 wherein the finishing means are driven by a single motor.

6. A concrete floor finishing machine as set forth in claim 1 which includes a motor for adjusting said pair of propelling means relative to the floor.

7. A concrete floor finishing machine comprising a vehicle body including a pair of rotatable finishing means for smoothing out concrete floor surfaces in half-set state, a pair of propelling means supported on supports relative to said vehicle body, one each of said propelling means confined within an area encompassed by each of said rotatable finishing means, said finishing means respectively having extreme ends movable on paths of revolution overlapping each other and driven to revolve around the propelling means in synchronism, and means for rotating each of said supports supporting said propelling means to change the direction of movement of said propelling means and said machine.

8. A concrete floor finishing machine as claimed in claim 7, wherein said means for rotating each of said supports that support said propelling means to change direction of movement is a clutch.

* * * * *